US010767311B2

(12) United States Patent
Walesch et al.

(10) Patent No.: US 10,767,311 B2
(45) Date of Patent: Sep. 8, 2020

(54) FIBROUS SUBSTRATE FOR PRODUCING A POROUS COATING BASE PAPER OR PREPREG, AND METHOD FOR THE PRODUCTION THEREOF

(71) Applicants: Schattdecor AG, Thansau (DE); Factum Consult GmbH, Munich (DE)

(72) Inventors: Dieter Walesch, Munich (DE); Tanja Zimmermann, Duebendorf (CH); Gilberto Siqueira, Duebendorf (CH); Sebastien Josset, Duebendorf (CH)

(73) Assignees: Schattdecor AG, Thansau (DE); Factum Consult GmbH, Munich (DE)

( * ) Notice: Subject to any disclaimer, the term of this patent is extended or adjusted under 35 U.S.C. 154(b) by 0 days.

(21) Appl. No.: 15/578,727

(22) PCT Filed: Jun. 3, 2016

(86) PCT No.: PCT/EP2016/062732
§ 371 (c)(1),
(2) Date: Dec. 1, 2017

(87) PCT Pub. No.: WO2016/193485
PCT Pub. Date: Dec. 8, 2016

(65) Prior Publication Data

US 2018/0179707 A1 Jun. 28, 2018

(30) Foreign Application Priority Data

Jun. 3, 2015 (EP) ..... 15170612

(51) Int. Cl.
*D21H 11/18* (2006.01)
*D21H 27/26* (2006.01)
*D21H 17/67* (2006.01)

(52) U.S. Cl.
CPC ..... *D21H 11/18* (2013.01); *D21H 17/67* (2013.01); *D21H 17/675* (2013.01); *D21H 27/26* (2013.01)

(58) Field of Classification Search
USPC ..... 162/146
See application file for complete search history.

(56) References Cited

U.S. PATENT DOCUMENTS

2012/0080156 A1 4/2012 Laleg et al.

FOREIGN PATENT DOCUMENTS

| | | | |
|---|---|---|---|
| CN | 103180511 | B | 4/2016 |
| EP | 0648248 | A1 | 4/1995 |
| WO | 1994000523 | A1 | 1/1994 |
| WO | 2013109441 | A1 | 7/2013 |
| WO | 2014033409 | A1 | 3/2014 |

OTHER PUBLICATIONS

WO 2014/033409, Bras at al., machine translation, Mar. 2014.*
"El"—Erhard et al.,Senkung der Kosten gefüllter Papiersorten durch die Einlagerung von Faser-Füllstoff-Compounds auf Basis nanoskaliger Cellulosen (Reduction of costs of filled paper types via the deposition of fiber-filler compounds on the basis of nano-scaled celluloses), PTS-Forschungsbericht IGF 16359 (2012). (google translation of abstract provided at the end).
"E2"-Fang et al., Development, application and commercialization of transparent paper, Translational Materials Research 1, 015004 (Sep. 24, 2014).
"E3"-Siro et al., Microfibrillated cellulose and new nanocomposite materials; A review, Cellulose 17: 459-494 (2010).
"E4"—Khalil et al., Green composites from sustainable cellulose nanofibrils: a review, Carbohydrate Polymers 87, 963-979 (2012).
"E5"—Schlosser, Nano Disperse Cellulose and Nano Fibrillierte Cellulose-neue Produkte für die Herstellung und Veredlung von Papier and Karton (Nano Disperse Cellulose and Nano Fibrillated Cellulose—new products for the production and finishing of paper and cardboard), special edition from "Wochenblatt für Papierfarbrikation," (Weekly paper for paper production) No. 6: pp. 1-11 (Mar. 28, 2008). (google translation of abstract provided at the end).
"E6"-Josset, S. et al., Energy consumption of the nanofibrillation of bleached pulp, wheat straw and recycled newspaper through a grinding process, Nordic Pulp & Paper Research Journal 29, 167-175 (Jan. 2014).
Andresen et al., Properties and characterization of hydrophobized microfibrillated cellulose, Cellulose 2006, 13, 665-677 (2006).
Bardet et al., Different strategies for obtaining high opacity films of MFC with TiO2 pigment, Cellulose 2013, 20, 3025-3037 (2013).
Herrick et al., Abstract of Microfibrillated cellulose: Morphology and accessibility, J. Appl. Polym. Sci. Appl. Polym. Symp. 1983, 37, 797-813 (1983). (Abstract).
Istek et al., The effect of decor paper and resin type on the physical, mechanical, and surface quality properties of particleboards coated with impregnated décor papers, Bioresources 2010, 5, 1074-1083 (2010).

(Continued)

*Primary Examiner* — Mark Halpern
(74) *Attorney, Agent, or Firm* — Agris & Von Natzmer, LLP; Joyce Von Natzmer

(57) ABSTRACT

A fibrous substrate material for producing a porous coating base paper or prepreg comprises a planar impregnatable structure made of cellulose fibers, which contains at least one pigment species and optionally contains further additives conventional for paper. The cellulose fibers contain a proportion of 1 to 20 wt.-% of nanofibrillated cellulose (NFC). A method for producing the fibrous substrate material comprises the steps of:

providing an aqueous suspension containing a cellulose containing material and an admixture of said pigment species and, optionally, further additives conventional for paper,
sheet forming,
drying.

The cellulose containing material contains a proportion of 1 to 20 wt.-% of NFC with a specific surface (SSA) of at least 125 $m^2/g$.

7 Claims, 2 Drawing Sheets

(56) References Cited

OTHER PUBLICATIONS

Iwamoto et al., Elastic modulus of single cellulose microfibrils from tunicate measured by atomic force microscopy, Biomacromolecules 2009, 10, 2571-2576 (2009).
Lu et al., Surface modification of microfibrillated cellulose for epoxy composite applications, Polymer 2008, 49, 1285-1298 (2008).
Nakagaito et al., Novel high-strength biocomposites based on microfibrillated cellulose having nano-order-unit web-like network structure, Appl. Phys. A-Mat. Sci. Process. 2005, 80, 155-159 (2005).
Turbak et al., Abstract of "Microfibrillated cellulose, a new cellulose product: Properties, uses, and commercial potential", J. Appl. Polym. Sci. Appl. Polym. Symp. 1983, 37, 815-827 (1983). (Abstract).
Zimmermann et al., Cellulose fibrils for polymer reinforcement, Adv. Eng. Mat. 2004, 6, 754-761 (2004).
Felix Schoeller Holding GmbH & Co KG; Opposition against EP 3303701 B1, Oct. 30, 2019, citing "E1-E6" (Non-Patent Literature Documents of IDS of Apr. 13, 2020).

* cited by examiner

FIBROUS SUBSTRATE FOR PRODUCING A POROUS COATING BASE PAPER OR PREPREG, AND METHOD FOR THE PRODUCTION THEREOF

CROSS-REFERENCE TO RELATED APPLICATIONS

This is the U.S. national stage of International application PCT/EP2016/062732, filed Jun. 3, 2016 designating the United States and claiming priority to European patent application EP 15170612.4, filed Jun. 3, 2015.

FIELD OF THE INVENTION

The present invention relates to a fibrous substrate material according to the preamble of claim 1 and to a method for the production thereof. Moreover, the invention relates to a coating base paper or prepreg formed from the substrate material according to the present invention. The products according to the present invention are provided for the production of coating substrates for furniture surfaces and furniture foils, but also for walls, floors and ceilings.

BACKGROUND OF THE INVENTION

The main objectives in the production of such papers are their qualitative properties in terms of strength, impregnation behavior, varnishability and printability, which are necessary for the further processing steps, but also the optical goals of achieving the required and specified coloring. In all cases, the paper has to be provided with color thoroughly and in depth. Coating base papers are produced in all degrees of color/saturation/brightness that might be obtained metrologically from the entire color spectrum.

Coating base papers, sometimes also referred to as decor base papers, are highly technical special papers which are printed on with aqueous or solvent containing dye systems or which are processed further in an unprinted or monochrome form. This applies to all conventional printing processes such as gravure printing, offset printing, flexographic printing, screen printing, but also to all non-impact printing processes such as digital printing systems. The further processing may be divided essentially into the processes of impregnating, painting, pressing onto wood-based materials or lamination onto wood-based materials or other sheetlike materials.

Wood-based materials are chipboards, fiberboards, medium density fiberboards (MDF) and high-density fiberboards. However, it is also possible to coat or laminate boards made of a whole variety of other materials such as, in particular, mineral materials, plastics or metals.

Another type of further processing of such papers is the production of decorative laminate boards, which are produced from impregnated, printed and/or deeply through-colored coating base papers and core papers by being pressed to a homogeneous board, or which are produced in an endless process [1].

Coating base papers have to be producible in all the colors of the color spectrum that can be perceived by the human eye, including the highest brightness (white) and the highest darkness level (black). In order to achieve a specific color at a specified color location along with certain physical properties, organic and inorganic pigments of various particle sizes are used with different mixing ratios and concentrations. To meet and maintain all of the physical conditions and requirements, fillers are used additionally.

An important pigment that is used to improve the brightness and opacity of the paper is titanium dioxide ($TiO_2$). In general, titanium dioxide is added to the fibrous paper in a "wet-end process" (see for example WO 2013/109441 A1).

Coating base paper provided as a fibrous substrate is the most economical, flexible and functional solution for providing designed and styled surfaces for a wide variety of applications such as furniture for living and sleeping areas, kitchens, offices, bathrooms, floors, interiors of large objects such as airports, hotels, office buildings, buildings of public interest such as museums, galleries (see for example WO 2013/109441 A1).

Coating base paper needs to have a very high opacity which should be as close as possible to 100%. The coating capacity against the background, i.e. against the color of the substrate material, shall be ensured without loss of color impression. Crucial factors to reach this goal are the content (amount) and the distribution of pigments and fillers within the paper body. The limiting amount is predetermined by the requirements regarding the strength of the paper.

It is basically known that the limiting amount can be raised by increasing the areal density of the paper. Thus, if the areal density of the paper is high enough, the desired 100% opacity can almost be reached. According to the known state of the art, there are commercial limits for the reasonable use of pigments and fillers.

The most commonly used pigments, i.e. white (titanium dioxide) and colored (iron oxides), represent a high value and are subject to immense, cyclical price fluctuations. Therefore, reaching a maximum yield is very important. This in turn means that the pigments/fillers in the paper body must have a maximal particle distribution in order to achieve the best possible opacity and the best coating capacity. Up to present it has not been possible to reach this standard. The pigments/fillers are generally present in the paper body as agglomerates. As a consequence, the light-scattering layers overlap and reduce the opacity effects and give rise to a different color perception.

In order to reduce the agglomeration phenomena, specific binders, fillers or dispersants are used, whereby an improvement of the light scattering efficiency is achieved [2]. However, in view of the increasing importance of environmental concerns and also because of the increasing costs of the raw material, new solutions are being worked out which should lead to a reduction of the titanium dioxide requirements through the use of biomaterials.

Accordingly, it is an object of the present invention to provide a fibrous substrate material, in particular a coating base paper, which stands out for high quality, in particular for high opacity, low requirement for pigments and good mechanical stability. A further object of the present invention is to provide a method for producing the substrate material according to the present invention. As a further object of the present invention, there is provided a coating base paper or a prepreg with improved properties.

DESCRIPTION OF THE INVENTION

The above-mentioned objects are achieved according to the present invention by the fibrous substrate material, by the production method and by the porous coating base paper or the prepreg as claimed and/or disclosed.

Advantageous embodiments of the invention are defined in the dependent claims.

The fibrous substrate material according to the present invention comprises, in a known manner, a planar structure made of cellulose fibers, which, moreover, contains at least one pigment species and optionally contains further additives conventional for paper. Further, the cellulose fibers contain a proportion of 1 to 20 wt.-% of nanofibrillated cellulose, wherein the percental specification here is related to the total weight of all the cellulose fibers. As will be explained in more detail below, in the present context the term "nanofibrillated cellulose", also abbreviated here as "NFC", is to be understood as cellulose fibers with a diameter of approximately 3 nm to approximately 200 nm and a length of at least 500 nm and an aspect ratio (length: diameter) of at least 100. According to the present invention, the NFC has a specific surface (SSA) of at least 125 $m^2/g$.

Typically, the NFC fibers have a diameter of 10 to 100 nm, with an average of 50 nm, and a length of at least a few micrometers, and the aspect ratio can be 1,000 or more.

According to one embodiment of the invention (claim 2), the NFC proportion is 5 to 10 wt.-%.

Surprisingly, it has been found that the embedding of a proportion of NFC into the planar structure made of cellulose fibers has various advantageous effects on a fibrous substrate material produced therewith, which is provided, in particular, for producing a porous coating base paper or prepreg.

So far, it has been known that the addition of NFC leads to a densification of the paper. This usually leads to the result that the air permeability worsens, or the associated Gurley value becomes higher. However, surprisingly, it has been found that the coating base paper produced according to the present invention achieves, in spite of higher Gurley values or lower air permeability, a still very good resin impregnability, an improved topography and printability.

It is already known that the addition of NFC can have beneficial effects on strength. For example, EP 1936032 A1 describes a method for producing multilayer paper products, particularly cardboard with low density such as beverage cartons. Thereby, the main goal is to lower the grammage or areal weight while maintaining the strength properties.

In the context of the present invention, it has been found as a new effect that the addition of NFC in the process of forming strongly pigment-containing porous, absorptive coating base papers or prepregs allows for a significantly more homogeneous embedding of the pigment species within the fiber network, which has very advantageous effects. The direct advantage resulting therefrom is that a given pigment content results in a significantly higher opacity or that a given opacity can be achieved with a lower pigment content. This results in clear economic as well as ecological advantages. A directly evident advantage results from the saving of pigment material with concomitant cost reduction, but also with reduced dust formation during processing. Moreover, chemicals which are currently used to improve pigment retention can advantageously be avoided or reduced in terms of the required amount thereof. A further, very significant advantage of the lower pigment content for a given opacity lies in a further improvement in the structural integrity, in particular in the tear resistance of the fibrous substrate structure, i.e. of the coating base paper. This applies in all directions within the substrate structure and both in the dry and in the wet state.

Apparently, there is a synergistic effect of the addition of NFC: on the one hand the addition appears to cause a better mechanical cohesion through formation of additional hydrogen bonds, and on the other hand the addition seems to provide an additional contribution to the mechanical cohesion due to the possibility of reducing the pigment content, and also a more homogeneous distribution of the pigment through formation of comparatively small agglomerates and avoidance of larger lumps. Larger agglomerates would act as weak points and reduce the tear resistance of the fibrous carrier material.

A further, surprising advantage of the fibrous substrate material according to the present invention in the use thereof as coating base paper results from an improvement of the surface topography, which leads to better printability and dye acceptance with concomitant savings of the commonly used printing dyes. Cellulose nanofibers (hereinafter abbreviated as NFC) have been extensively studied and described in the literature over the past 20 years. Also in the field of general papermaking such nanofibers have been proposed as a possible "wet end" additive for improving certain properties of the paper. However, it is also known that the addition of significant amounts of NFC generally results in a loss of opacity [3], which is highly undesirable, in particular, for coating base papers.

NFC is generally obtained by a mechanical crushing process starting from wood and other vegetable fibers; first descriptions go back to Herrick et al. [4] and Turback et al. [5] in the year 1983. The new material thus obtained was initially called microfibrillated cellulose (MFC). Nowadays, however, various other terms such as cellulose nanofibers (CNF), nanofibrillated cellulose (NFC) and cellulose nano- or microfibrils are commonly used in addition to the term MFC. It is a semicrystalline cellulosic material made of cellulosic fibers with high aspect ratio (=ratio of length to diameter), lower degree of polymerization compared with intact plant fibers and with a correspondingly strongly increased surface, which is obtained for example by a homogenization or grinding process [6].

In contrast to the straight-line "cellulose whiskers", which are also referred to as "cellulose nanocrystals" and which have a rod-shaped form with a length of usually 100 to 500 nm (depending on the cellulose source, there are also crystals with a length of up to 1 μm), the cellulose nanofibers are long and flexible. The NFC obtained therefrom usually contains crystalline and amorphous domains and has a network structure due to strong hydrogen bonding [7, 8, 9].

The term "additives conventional for paper" is to be include, in particular, fillers.

The pigments and fillers contained in the substrate material according to the present invention are preferably selected from the group consisting of metal oxides, oxides and/or mixed oxides of a semi-metal/semiconductor or mixtures thereof. Preferably, the pigments/fillers may be selected from, but are not limited to the group consisting of silicon, magnesium, calcium, aluminum, zinc, chromium, iron, copper, tin, lead or mixtures thereof.

Preferred pigments/fillers are silicic acids, aluminum oxides, iron oxides, magnesium silicate, magnesium carbonate, titanium dioxide, tin oxide, aluminum silicate, calcium carbonate, talcum, clay, silicon dioxide, inorganic substances such as diatomite, organic substances such as, for example, melamine formaldehyde resin, urea formaldehyde resin, acrylates, polyvinyl alcohol, modified polyvinyl alcohol, polyvinyl acrylate, polyacrylates, synthetic binders, binders of natural origin such as starch, modified starch, carboxymethyl cellulose or mixtures thereof.

A particularly preferred pigment species for forming a white coloration is titanium dioxide (claim 3). A further pigment species used for many applications is iron oxide (claim 4).

According to a further aspect (claim 5), a method for producing the substrate material according to the present invention comprises the steps of:

providing an aqueous suspension containing a cellulose containing material and an admixture of said pigment species and, optionally, further additives conventional for paper, sheet forming, drying, wherein the cellulose containing material contains a proportion of 1 to 20 wt.-% of NFC with a specific surface (SSA) of at least 125 $m^2/g$.

Generally, it has been found that using NFC with a specific surface (SSA) of 100 $m^2/g$ or less shows significantly worse results in terms of measurable surface topography, printability and of retention capacity for pigments such as titanium dioxide.

Moreover, it is remarkable that the use of highly ground cellulose instead of NFC does not lead to the quality improvement according to the present invention. Without being bound to a specific theory, this finding indicates that the advantages of the present invention cannot be achieved simply by crushing of cellulose into particles with dimensions in the nanometer range, but rather that for this purpose the forming of fibers with a diameter in the nanometer range and an aspect ratio of at least 100 is required.

According to one embodiment of the method (claim 6) the NFC proportion is 5 to 10 wt.-%.

The NFC used for the above process should have a specific surface (SSA) of at least 150 $m^2/g$, in particular at least 175 $m^2/g$, preferably at least 225 $m^2/g$ (claim 7).

Advantageously, the method according to the present invention uses a papermaking method which is suitable and optimized for the production of coating base paper. Such methods are known in principle. In the context of the present invention, the method will have to be modified in such manner that either directly before formation of an aqueous suspension or following such formation the mentioned portion of 1 to 20 wt.-% of NFC is added to the cellulosic material. Again, this percentile amount is related to the total weight of all the cellulose fibers.

According to a further aspect, a porous coating base paper is provided which stands out by a higher opacity for a given pigment content or by a lower pigment requirement for a given opacity, and at the same time is processable further by commercially available methods such as those described e.g. in WO 2013/109441 A1.

According to yet another aspect, a prepreg is provided wherein the substrate material of the present invention is impregnated with a suitable synthetic resin dispersion. Prepregs are produced in a known manner by impregnating a fibrous substrate material with an impregnating resin solution (see, for example EP 0648248 B1). This impregnating step is carried out already in the paper machine. Subsequently, the prepregs can be provided with a print motif.

The prepregs according to the present invention stand out for advantages already mentioned in connection with the coating base paper of to the present invention.

The products according to the present invention are used as surface layers for various sheetlike materials, in particular laminates. Such laminates are known, in particular, as "high pressure laminates (HPL)" and "low pressure laminates". These can be used indoors for floors, walls and ceilings and any furniture surfaces. It will be understood that depending on the application, the surface layer is further provided with an additional protective layer (overlay) or it is lacquered.

LITERATURE

1. Istek, A.; Aydemir, D.; Asku, S. The effect of decór paper and resin type on the physical, mechanical, and surface quality properties of particleboards coated with impregnated décor papers. Bioresources 2010, 5, 1074-1083.
2. Bardet, R.; Belgacem, M. N.; Bras, J. Different strategies for obtaining high opacity films of MFC with TiO2 pigment. Cellulose 2013, 20, 3025-3037.
3. Herrick, F. W.; Casebier, R. L.; Hamilton, J. K.; Sandberg, K. R. Microfibrillated cellulose: Morphology and accessibility. J. Appl. Polym. Sci. Appl. Polym. Symp. 1983, 37, 797-813.
4. Turbak, A. F.; Snyder, F. W.; Sandberg, K. R. Microfibrillated cellulose, a new cellulose product: Properties, uses, and commercial potential. J. Appl. Polym. Sci. Appl. Polym. Symp. 1983, 37, 815-827.
5. Nakagaito, A. N.; Yano, H. Novel high-strength biocomposites based on microfibrillated cellulose having nano-order-unit web-like network structure. Appl. Phys. A-Mat. Sci. Process. 2005, 80, 155-159.
6. Andresen, M.; Johansson, L. S.; Tanem, B. S.; Stenius, P. Properties and characterization of hydrophobized microfibrillated cellulose. Cellulose 2006, 13, 665-677.
7. Lu, J.; Askeland, P.; Drzal, L. T. Surface modification of microfibrillated cellulose for epoxy composite applications. Polymer 2008, 49, 1285-1298.
8. Zimmermann, T.; Pöhler, E.; Geiger, T. Cellulose fibrils for polymer reinforcement. Adv. Eng. Mat. 2004, 6, 754-761.
9. Iwamoto, S.; Kai, W.; Isogai, A.; Iwata, T. Elastic modulus of single cellulose microfibrils from tunicate measured by atomic force microscopy. Biomacromolecules 2009, 10, 2571-2576.

BRIEF DESCRIPTION OF THE DRAWINGS

Examples of the invention will henceforth be described in more detail by reference to the drawings, in which are shown, in.

MODES FOR CARRYING OUT THE INVENTION

Example 1

Figure 1:
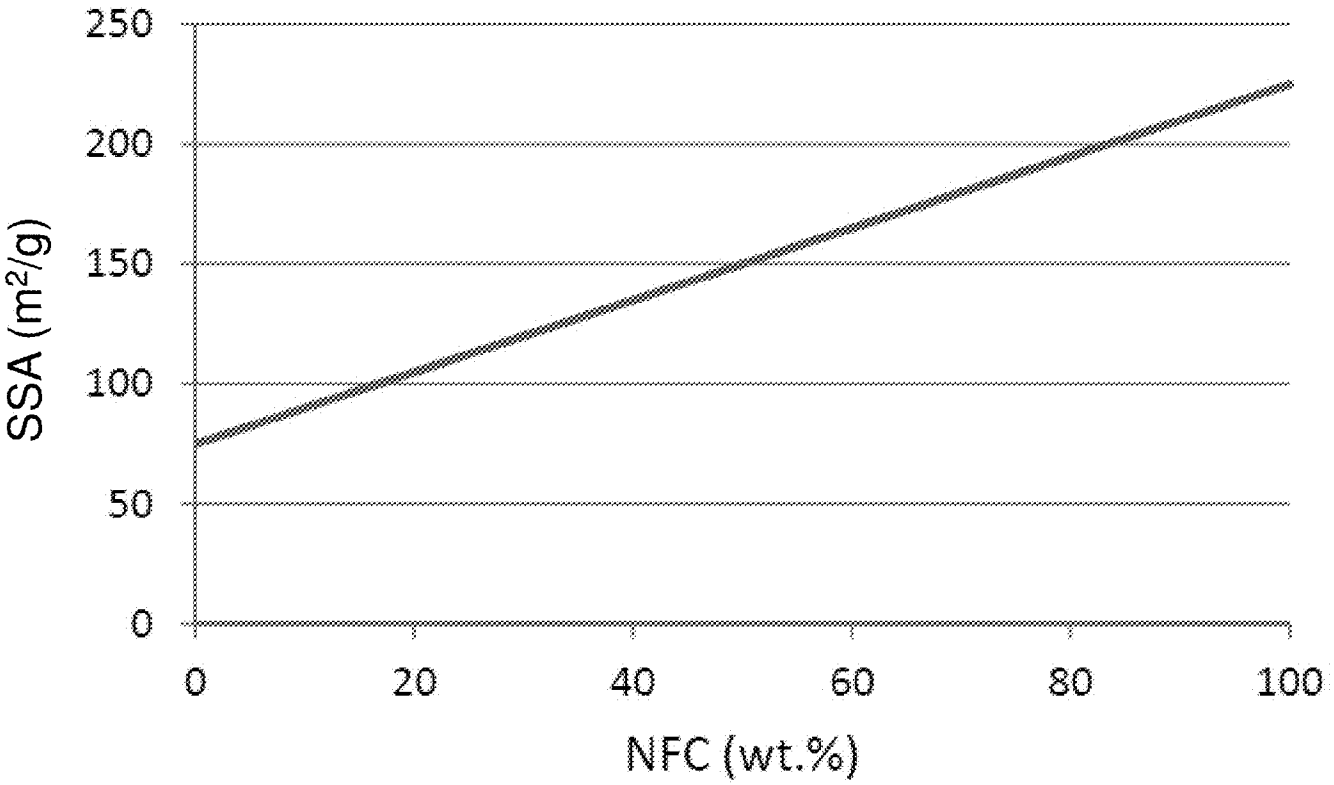
FIG. 1 the specific surface area SSA in $m^2/g$ of NFC containing cellulose as a function of weight proportion of NFC.

As shown in FIG. 1, the specific surface area SSA in $m^2/g$ of NFC containing cellulose increases linearly as a function of the weight proportion of NFC. While, in the example shown, it is only about 75 $m^2/g$ for conventional cellulose without NFC addition, it has values of around 225 $m^2/g$ in the case of 100% NFC; for more details see: Josset, S. et al. Energy consumption of the nanofibrillation of bleached pulp, wheat straw and recycled newspaper through a grinding process. *Nordic Pulp & Paper Research Journal* 29, 167-175 (2014).

For a comparative evaluation of the properties of conventional coating base papers without NFC and of such base papers with NFC, paper blanks with a constant pulp density of 50 $g/m^2$ and progressively larger TiO2 contents were produced by means of a sheet former (Estanit, Mülheim an der Ruhr, Deutschland, based on DIN EN ISO 5269-2-DIN 54358).

Bleached pulp made of wood fibers was ground by a standard method to a Schopper-Riegler value of 35 SR°.

A first 1 wt.-% suspension of this pulp was prepared to produce standard paper blanks.

A second 1 wt. pulp suspension with 5 wt.-% NFC (related to the total pulp amount) was prepared to produce modified paper blanks. The NFC made of softwood fibers (ECF, company Stendal, D) was produced by the method described in the following reference: Josset, S. et al. Energy consumption of the nanofibrillation of bleached pulp, wheat straw and recycled newspaper through a grinding process. *Nordic Pulp & Paper Research Journal* 29, 167-175 (2014).

For sheet production, in each case, 150 mL of a suspension were diluted to 4 L (corresponding to 50 $m^2/g$ pulp in the paper produced). To this pulp, TiO2 was added in progressively increasing amounts (0.1 g to 2.0 g of a 10-wt. suspension). Each mixture was adjusted to a pH of about 6.3 by means of $Al_2SO_4$ and treated by means of a homogenization system (Ultraturrax) for 30 seconds at 15,000 rpm. Sheets were then produced by vacuum filtration (according to DIN EN ISO 5269-2) and subsequently vacuum-dried. A sample was taken from each leaf in order to determine its $TiO_2$ content by ashing (900° C., 10 min).

The remaining material was pressed onto a black background with an overlay paper impregnated with aqueous melamine resin to form a high gloss composite (60 bar, 2 min at 150° C., re-cooling: 5 min, to about 45°-50° C.). The average light reflection of these pressed sheets was determined by means of a spectrophotometer (Konika Minolta, CM-2500D) between 360 and 740 nm.

Figure 2:
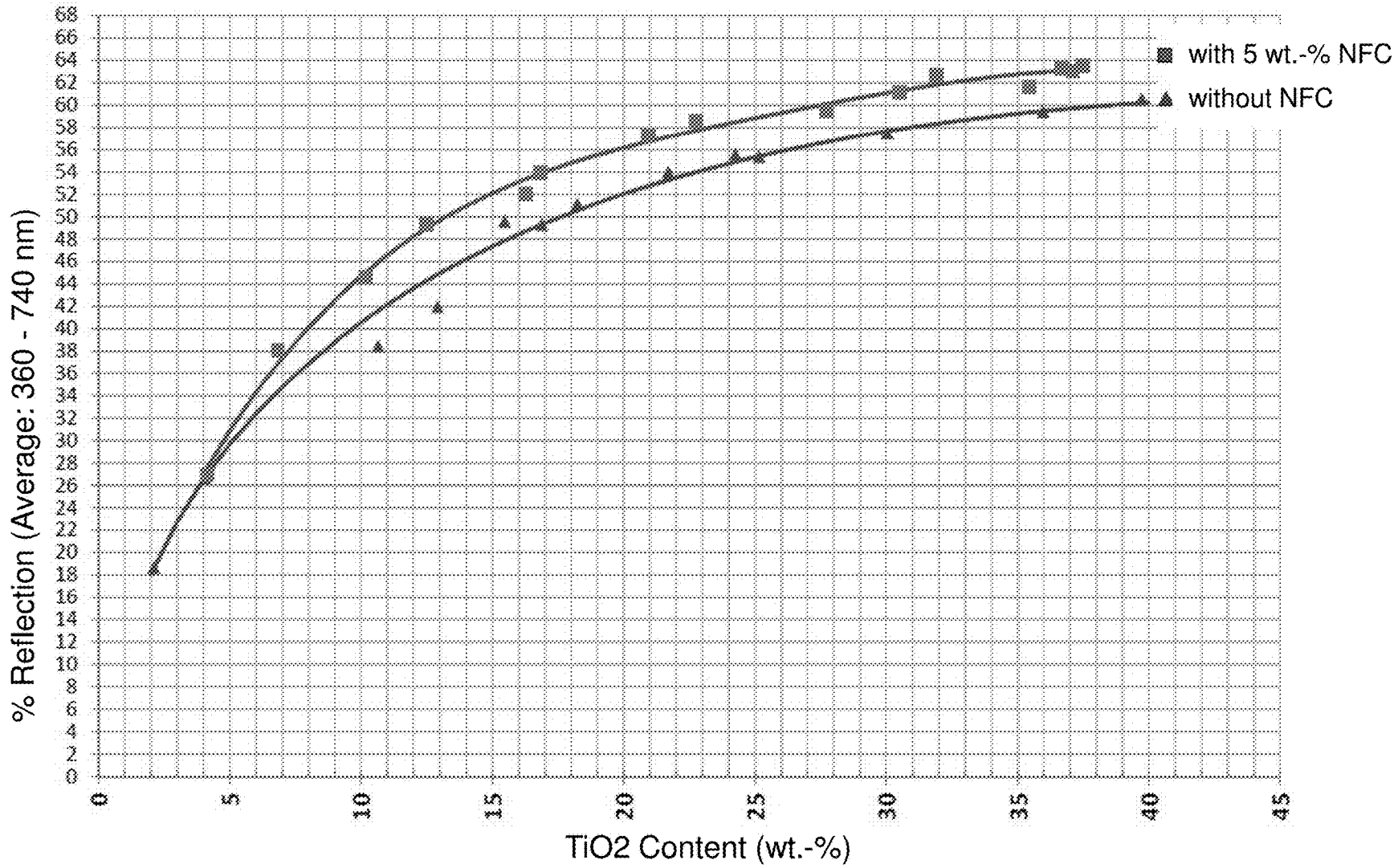
FIG. 2 the light reflection (average taken in the band from 360 to 740 nm) on a black background as a function of the TiO2 content in wt.-%, for pressed sheets obtained with papers without NFC (triangles) and with papers with 5 wt.-% NFC (squares).

As shown in FIG. 2, the addition of 5 wt.-NFC results in a significant increase of the light reflection capacity. For example, at a TiO2 content of about 17 wt.-% the light reflection increases from about 49% (without NFC) to about 54% (with NFC). Moreover, the behavior in the flattening region of the curves at higher TiO2 content is particularly remarkable. For example, to achieve a reflection of 54%, conventional paper requires a TiO2 content of about 22 wt.-% which can be reduced to about 17 wt.-% in the case of addition of 5 wt.-% NFC. This corresponds to 22% saving of TiO2.

Example 2

Several sections of monolayer fibrous substrate material were produced using NFC of various types, i.e. with different values of the specific surface area (SSA), in the above-mentioned manner. The ash content in wt.-% was used as a standard measure of the retention capacity of the mineral components, here in particular of titanium dioxide. The following results each are given as the mean of 3 measurements.

For the production without NFC considered as reference base, an ash content of 30.8 wt.-% was found.

Using an NFC with a SSA of about 95 $m^2/g$ (prior art), the ash content was 32.6 wt.-%, which corresponds to an absolute increase of 1.8 wt.-% compared to the reference.

Using an NFC with a SSA of about 165 $m^2/g$ (according to the present invention), the ash content was 38.9 wt.-%, which corresponds to an absolute increase of 8.2 wt.-% compared to the reference.

Using an NFC with a SSA of about 225 $m^2/g$ (according to the present invention), the ash content was 43.5 wt.-%, which corresponds to an absolute increase of 12.7 wt.-% compared to the reference.

The invention claimed is:

1. A fibrous substrate material for producing a porous coating base paper or prepreg, comprising:

a planar impregnatable structure made of cellulose fibers, which contains at least one pigment species and which optionally contains further additives conventional for paper, wherein the cellulose fibers contain a proportion of 1 to 20 wt.-% of nanofibrillated cellulose (NFC) with a specific surface (SSA) of at least 125 $m^2/g$, wherein the fibrous substrate material is single-layered.

2. The fibrous substrate material according to claim 1, wherein the NFC portion is 5 to 10 wt.-%.

3. The fibrous substrate material according to claim 1, wherein the said pigment species is titanium dioxide.

4. The fibrous substrate material according to claim 1, wherein the said pigment species is iron oxide.

5. The fibrous substrate material according to claim 2, wherein the said pigment species is titanium dioxide.

6. The fibrous substrate material according to claim 2, wherein the said pigment species is iron oxide.

7. The fibrous substrate material according to claim 1, wherein the SSA of the NFC is at least 175 $m^2/g$.

* * * * *